US009878458B2

(12) United States Patent
Park et al.

(10) Patent No.: US 9,878,458 B2
(45) Date of Patent: Jan. 30, 2018

(54) UNITARY RAZOR BLADE AND SHAVING RAZOR CARTRIDGE USING SAME

(75) Inventors: Young Ho Park, Gunpo-si (KR); Su Hwan Kim, Seoul (KR); Byung Sun Ahn, Ansan-si (KR)

(73) Assignee: DORCO CO., LTD., Seoul (KR)

( * ) Notice: Subject to any disclaimer, the term of this patent is extended or adjusted under 35 U.S.C. 154(b) by 8 days.

(21) Appl. No.: 13/132,077

(22) PCT Filed: Jan. 28, 2010

(86) PCT No.: PCT/KR2010/000521

§ 371 (c)(1),
(2), (4) Date: May 31, 2011

(87) PCT Pub. No.: WO2010/093133

PCT Pub. Date: Aug. 19, 2010

(65) Prior Publication Data

US 2011/0232100 A1 Sep. 29, 2011

(30) Foreign Application Priority Data

Feb. 11, 2009 (KR) ..... 10-2009-0010877

(51) Int. Cl.
*B26B 21/56* (2006.01)
*B26B 21/28* (2006.01)

(52) U.S. Cl.
CPC ..... *B26B 21/565* (2013.01); *B26B 21/28* (2013.01)

(58) Field of Classification Search
CPC ..... B26B 21/28; B26B 21/4031; B26B 21/52; B26B 21/565
USPC ..... 30/47–53
See application file for complete search history.

(56) References Cited

U.S. PATENT DOCUMENTS 1,924,262 A * 8/1933 Thompson ..... B26B 21/18 30/346.61
2,421,205 A * 5/1947 Kingsley ..... 30/49
3,331,129 A * 7/1967 Goudie ..... 30/49
3,587,171 A * 6/1971 Perry ..... 30/40.1
4,459,744 A * 7/1984 Esnard ..... 30/49
4,516,320 A * 5/1985 Peleckis ..... 30/49
(Continued)

FOREIGN PATENT DOCUMENTS

CN 1864947 A 11/2006
JP 50-98978 8/1975
(Continued)

OTHER PUBLICATIONS

International Search Report for PCT/KR2010/000521 dated Oct. 11, 2010.

*Primary Examiner* — Jonathan Riley
(74) *Attorney, Agent, or Firm* — Myers Wolin, LLC

(57) ABSTRACT

The present invention relates to a unitary razor blade and to a shaving razor using the same, and more particularly, to a razor blade which is shaped into a geometrical structure so as to achieve the maximized strength thereof. The razor blade according to the present invention comprises: an edge portion having a curved cutting edge; a connection portion which extends from the edge portion and which is formed into a curve; and a support portion extending from the edge portion to support the edge portion and the connection portion, where the edge portion, the connection portion and the support portion are combined into a single body.

14 Claims, 5 Drawing Sheets

(56) References Cited

U.S. PATENT DOCUMENTS

| | | | | |
|---|---|---|---|---|
| 4,603,477 | A * | 8/1986 | Francis | B26B 21/56 30/346.56 |
| 4,621,424 | A * | 11/1986 | Jacobson | 30/41 |
| 4,720,917 | A * | 1/1988 | Solow | 30/49 |
| 4,901,437 | A * | 2/1990 | Iten | 30/50 |
| 4,976,028 | A * | 12/1990 | Chen | 30/49 |
| 4,993,154 | A * | 2/1991 | Radcliffe | 30/527 |
| 5,010,646 | A | 4/1991 | Neamtu | |
| 5,199,173 | A * | 4/1993 | Hegemann et al. | 30/49 |
| 5,208,982 | A * | 5/1993 | Ferruzza, Jr. | 30/49 |
| 5,704,127 | A * | 1/1998 | Cordio | 30/49 |
| 6,804,886 | B2 * | 10/2004 | Wain | 30/49 |
| 7,210,229 | B2 * | 5/2007 | Coffin | 30/50 |
| 2002/0092175 | A1 * | 7/2002 | Kameka | 30/49 |
| 2003/0046819 | A1 * | 3/2003 | Ferraro et al. | 30/527 |
| 2003/0204954 | A1 * | 11/2003 | Wain | 30/49 |
| 2004/0020053 | A1 * | 2/2004 | Wain | 30/50 |
| 2005/0102847 | A1 * | 5/2005 | King | 30/527 |
| 2005/0246899 | A1 * | 11/2005 | Wain | 30/49 |
| 2006/0277760 | A1 * | 12/2006 | Lee | 30/50 |
| 2007/0011880 | A1 * | 1/2007 | Pennell et al. | 30/50 |
| 2007/0124939 | A1 * | 6/2007 | Van Eibergen Santhagens | 30/50 |
| 2007/0234577 | A1 * | 10/2007 | Masek et al. | 30/346.55 |
| 2008/0022530 | A1 * | 1/2008 | Royle | 30/50 |
| 2008/0072431 | A1 * | 3/2008 | Ozenick | 30/50 |
| 2008/0196251 | A1 * | 8/2008 | Royle | 30/50 |

FOREIGN PATENT DOCUMENTS

| | | | | |
|---|---|---|---|---|
| JP | 04-068768 | | 6/1992 | |
| JP | 468768 | A | 6/1992 | |
| JP | 8-505555 | | 6/1996 | |
| JP | 2004-511319 | A | 4/2004 | |
| JP | 2009-018144 | A | 1/2009 | |
| KR | 10-2006-0023995 | | 3/2006 | |
| KR | 10-0749925 | | 8/2007 | |
| WO | WO 9206826 | A1 * | 4/1992 | B26B 19/28 |

* cited by examiner

[Fig. 1]
[Background Art]
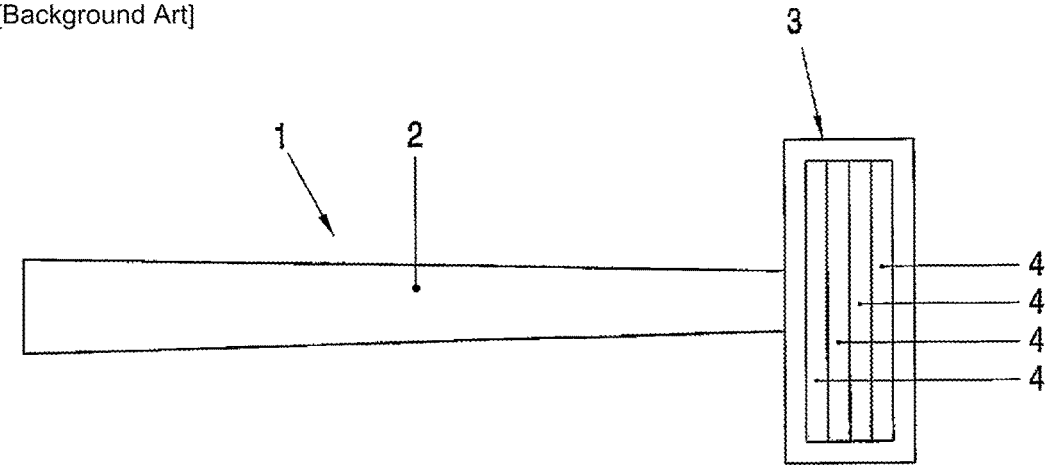
[Fig. 2] [Background Art]
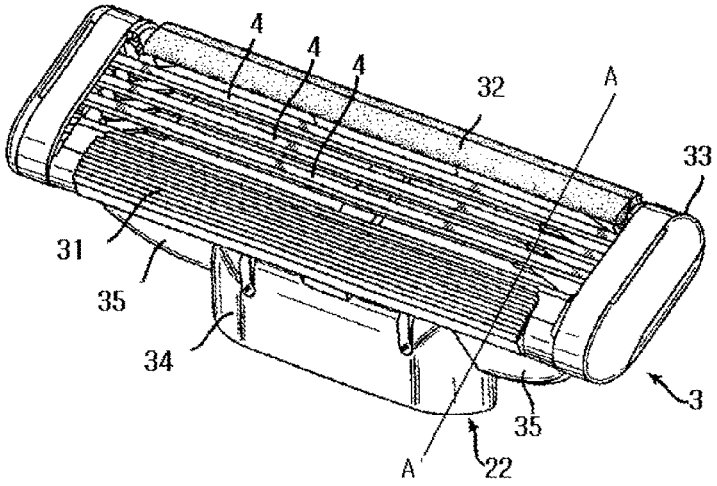

[Fig. 3]
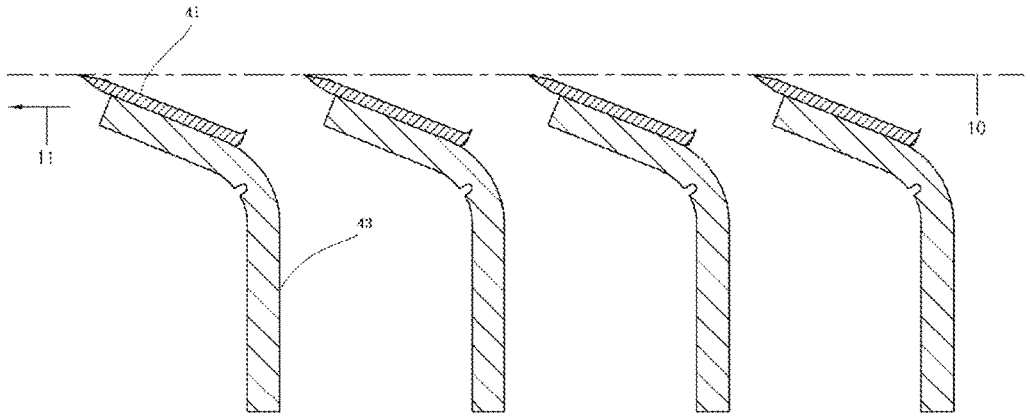
[Fig. 4]
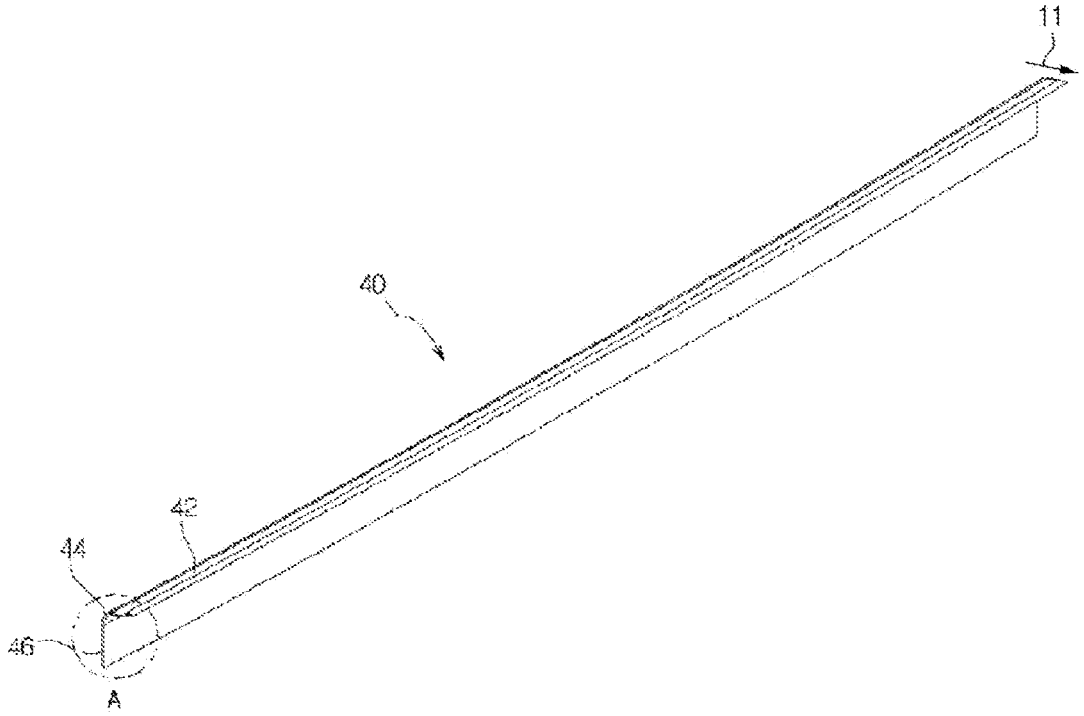

[Fig. 5]
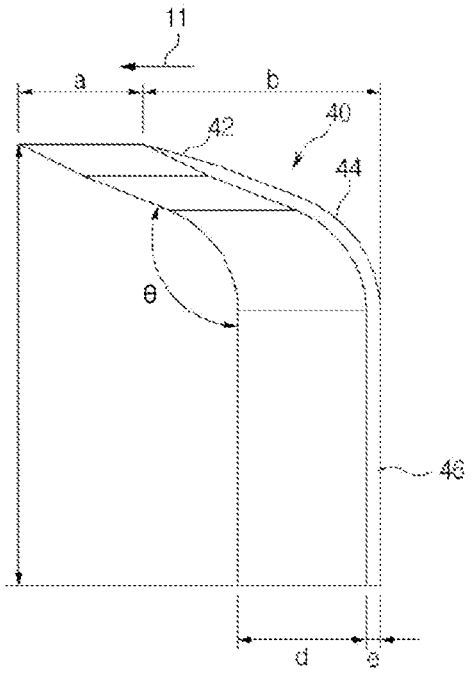
[Fig. 6]
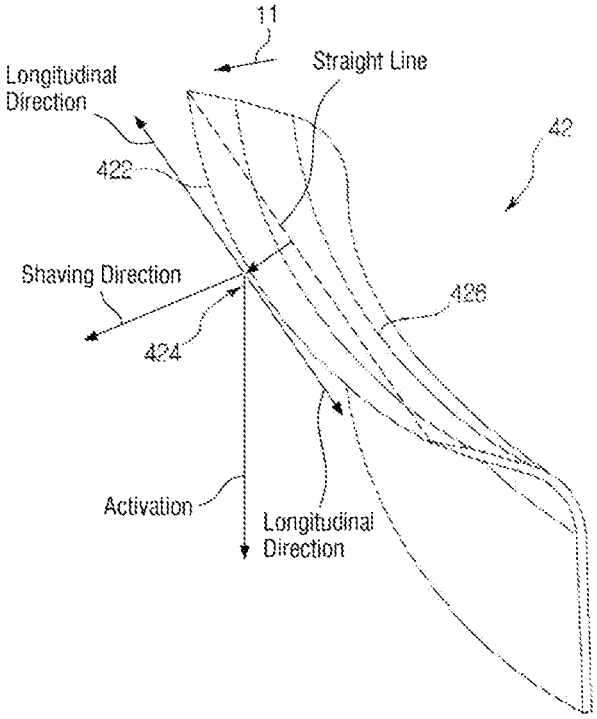

[Fig. 7]
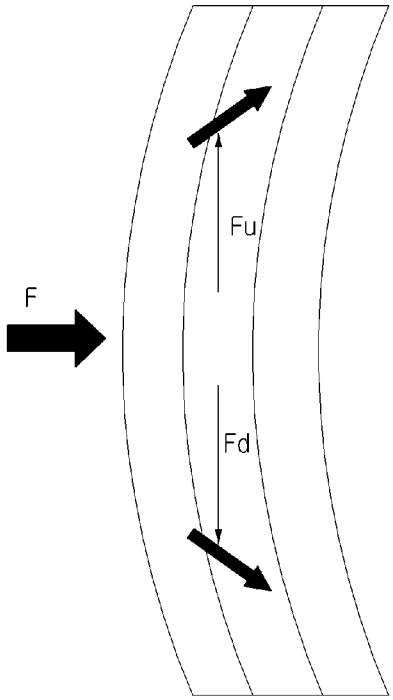
[Fig. 8]
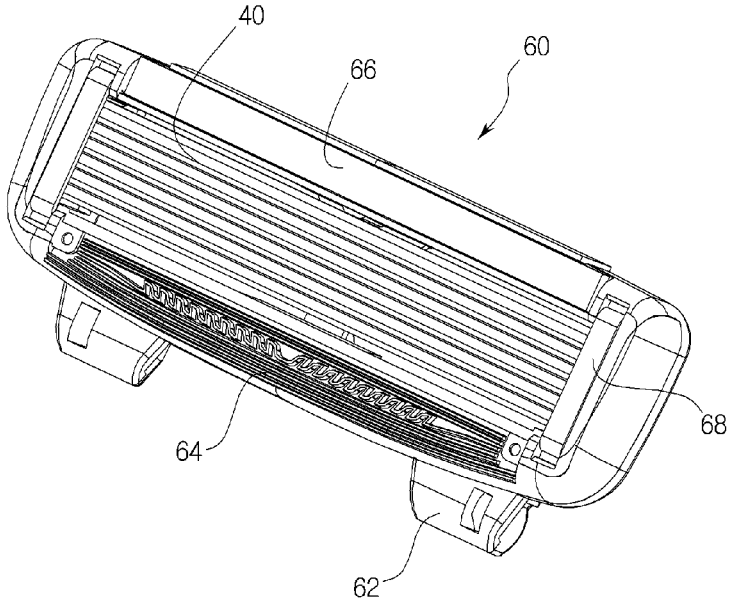

[Fig. 9]
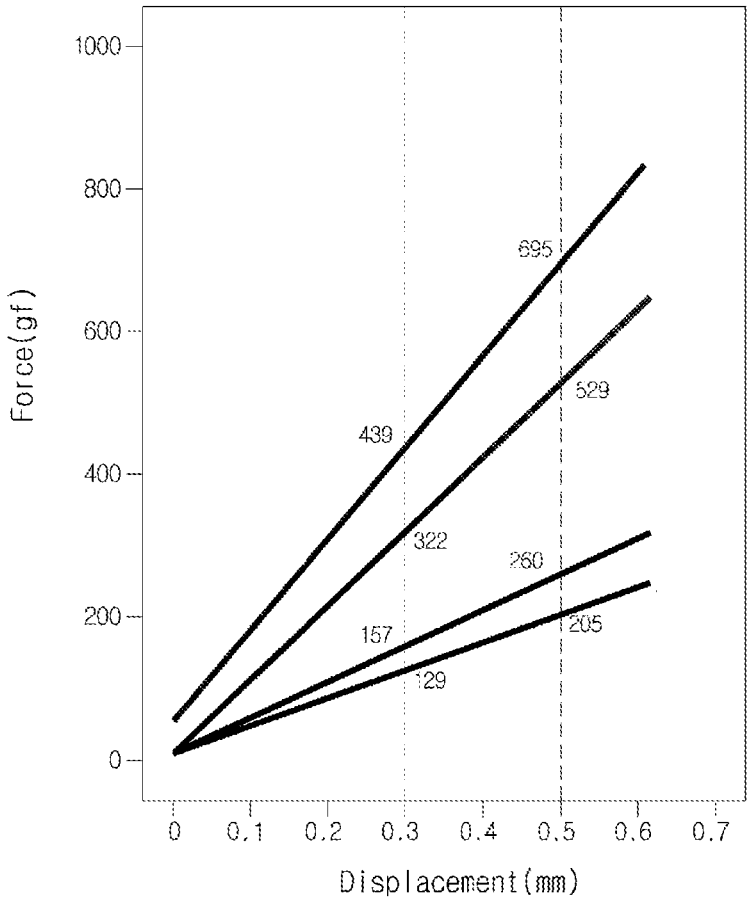

UNITARY RAZOR BLADE AND SHAVING RAZOR CARTRIDGE USING SAME

RELATED APPLICATIONS

This application is a 371 application of International Application No. PCT/KR2010/000521, filed Jan. 28, 2010, which in turn claims priority from Korean Patent Application No. 10-2009-0010877, filed Feb. 11, 2009, each of which is incorporated herein by reference in its entirety.

TECHNICAL FIELD

The present invention relates to a unitary razor blade and a shaving razor cartridge using the same, and more particularly, to a razor blade which is shaped into a geometrical structure so as to achieve the maximized strength thereof.

BACKGROUND ART

Shaving should give a sense of cleanness and avoid any cut or injury. Factors which affect the shaving performance include a frictional resistance between a razor blade edge and skin and the sharpness of the razor blade edge. Such factors include the force of a cutter applied to hair by the razor blade.

Increase in the number of razor blades in a shaving razor improves shaving efficiency of the shaving razor and well distributes a pressure to the skin, but also increases a drag force. Also, the increased number of razor blades takes more space or narrows the gap between cutting edges. Such increased area taken by the razor blades may adversely affect the shaving performance, and the narrower gap of the razor blades may deteriorate the shaving performance, and make it difficult to remove the shaving remainder. Conversely, if the gap between the razor blades is wider, the shaving performance may improve but users are more likely to be injured or cut by the razor blades. Accordingly, it is very important to properly adjust the gap between the razor blades.

To narrow the gap between the razor blades with the shaving performance secured and to remove the shaving remainder without difficulty, the thickness of the razor blades should be inevitably thin. However, if the razor blades are too thin, they cannot cut hair but may be easily deformed and deteriorate durability. Accordingly, it is required to provide a thin and strong razor blade.

As shown in FIGS. 1 and 2, a general wet shaving razor includes a grip 2, a cartridge 3 and a plurality of razor blades 4.

The cartridge 3 includes a housing 33 which accommodates therein the plurality of razor blades 4, a guard rubber 31 and a lubricant band 32. The cartridge 3 includes a connector 22 which is connected to the grip 2 so that the housing 33 rotates with respect to a rational shaft.

FIG. 3 is a sectional view of the cartridge 3, taken along line A-A' in FIG. 2. As shown therein, the razor blades 4 has a cutting edge 41 mounted on a supporter 43 to maintain a certain level of strength. Generally, the supporter 43 includes a strong aluminum alloy. That is, the cutting edge 41 is mounted on the supporter 43 by welding to prevent the razor blades 4 from being deformed or damaged when used.

The cutting edge 41 is located adjacently to a shaving direction 11 to reduce the risk of cut and ensure a comfortable shaving. An edge portion of the razor blades 4 is inclined at an acute angle to a shaving plan 10 to provide a comfortable shaving and prevents the cutting edge 41 to be worn to some extent.

However, the conventional technology requires a welding process to combine the cutting edge 41 and the supporter 43 which are manufactured in separate processes, incurring a lot of expenses and deteriorating manufacturing efficiency due to additional processes.

DISCLOSURE

Technical Problem

The present invention has been made to solve the problems and it is an object of the present invention to provide a thin and strong razor blade.

Another aspect of the present invention is to provide a razor blade in which a cutting edge and a supporter are combined into a single body and improves a manufacturing efficiency of the razor blade.

Further, another aspect of the present invention is to provide a razor blade and a shaving razor cartridge using the same, wherein the razor blade is shaped into a geometrical structure and distributes the pressure applied to skin when a user shaves.

Technical Solution

In order to achieve the object of the present invention, a razor blade comprises an edge portion which comprises a curved cutting edge; a connection portion which extends from the edge portion and forms a curved surface; and a support portion which extends from the connection portion and supports the edge portion and the connection portion, wherein the edge portion, the connection portion and the support portion are combined into a single body.

The edge portion comprises a rear portion that is concave.

The cutting edge protrudes in a circular shape and distributes a cutting pressure when hair is cut.

The distance from a central portion of the cutting edge to a straight line connecting opposite ends of the cutting edge ranges between 0.01 mm and 2.0 mm.

The distance from a central portion of the cutting edge to a straight line connecting opposite ends of the cutting edge is 0.2 mm.

The cutting edge protrudes in a circular shape and a radius of the circle ranges between 210 mm and 220 mm.

The thickness of the razor blade ranges between 0.075 mm and 0.2 mm.

In order to achieve the object of the present invention, a shaving razor cartridge comprises a housing; and a plurality of razor blades which comprises an edge portion mounted in the housing and comprising a curved cutting edge, a connection portion extending from the edge portion and forming a curved surface and a support portion extending from the connection portion and supporting the edge portion and the connection portion, wherein the edge portion, the connection portion and the support portion are combined into a single body.

The plurality of razor blades comprises two to ten razor blades.

The distance from the first razor blade to the last razor blade of the plurality of the razor blades ranges between 1.0 mm and 8.0 mm.

The distance between the plurality of razor blades ranges between 0.5 mm and 0.9 mm.

The edge portion comprises a rear portion that is concave.

The cutting edge protrudes in a circular shape and distributes a cutting pressure when hair is cut.

The distance from a central portion of the cutting edge to a straight line connecting opposite ends of the cutting edge ranges between 0.01 mm and 2.0 mm.

The distance from a central portion of the cutting edge to a straight line connecting opposite ends of the cutting edge is 0.2 mm.

The thickness of the razor blade ranges between 0.075 mm and 0.2 mm.

Advantageous Effect

A razor blade according to the present invention is thin and strong.

Also, a razor blade according to the present invention has a cutting edge and a supporter combined into a single body to improve manufacturing efficiency of the razor blade.

Further, a razor blade according to the present invention is shaped into a geometrical structure so as to achieve the maximized strength thereof.

Further, a razor blade according to the present invention is thin and removes the shaving remainder without difficulty.

BRIEF DESCRIPTION OF DRAWINGS

FIG. 1 illustrates a conventional shaving razor.

FIG. 2 illustrates a conventional shaving razor cartridge.

FIG. 3 is a sectional view of the shaving razor cartridge taken along line A-A' in FIG. 2.

FIG. 4 is a perspective view of a razor blade according to the present invention.

FIGS. 5 to 7 are enlarged views of the razor blade in FIG. 4.

FIG. 8 illustrates a shaving razor cartridge according to the present invention.

FIG. 9 is a graph which shows a strength test result of the razor blade according to the present invention and the conventional razor blade.

BEST MODE

Hereinafter, a detailed structure of a razor blade according to exemplary embodiments of the present invention will be described with reference to accompanying drawings.

FIG. 4 illustrates a razor blade according to an exemplary embodiment of the present invention.

Referring to FIG. 4, a razor blade 40 includes an edge portion 42 including a cutting edge 422 to cut hair, a connection portion 44 extending from the edge portion 42, and a support portion 46 extending from the connection portion 44 and supporting the razor blade 40, wherein the edge portion 42, the connection portion 44 and the support portion 46 are combined into a single body.

FIG. 5 is an enlarged view of a part A in FIG. 4. FIG. 6 is an enlarged view of the edge portion 42. FIG. 7 is a plan view of the razor blades 40.

As shown in FIG. 6, the edge portion 42 has a front portion 424 which is convex, and a rear portion 426 which is concave. If the razor blade is curved as above, the pressure applied to the cutting edge of the razor blade at the time of shaving is distributed and the razor blade can maintain its strength even in a thinner thickness to thereby prevent a deformation of the razor blade.

As shown in FIG. 7, if the force F is applied to the cutting edge 422, the forces Fu and Fd are distributed up and down along a curved surface, and thus the razor blade may maintain its strength even in a thinner thickness.

In FIG. 5, as the cutting edge 422 has a curved structure and the central portion of the razor blade protrudes, measures a and d are formed. Such measures depend on the entire length of the razor blade 40, and may range between 0.01 mm and 2.0 mm. If the razor blade 40 is 37.26 mm in length, the length of a and d is preferably about 0.2 mm. If a virtual starting point is set, a radius is 216.95 mm.

A distance from the cutting edge 422 to the support portion 46, i.e., a width b of the razor blades 40 may range between 1.0 mm and 3.0 mm, and preferably 1.8 mm. A height c of the razor blades 40 may range between 1.5 mm and 5.0 mm, and preferably 2.5 mm. A thickness e of the razor blades 40 may range between 0.05 mm and 0.2 mm, and preferably 0.075 mm.

The connection portion 44 may form an angle θ ranging between 90° and 170°, and preferably 112°.

As described above, if a razor blades are used, the gap between the razor blades 40 preferably ranges between 0.5 mm and 0.9 mm. Since the razor blades are thin, such gap is enough to prevent the deterioration of the shaving performance and to remove the shaving remainder without difficulty.

That is, if the razor blades 40 are shaped into a curved surface as above, the thickness of the razor blades 40 may be thinner, and the gap between the razor blades 40 in a shaving razor having a plurality of razor blades may be narrowed and a remainder discharger of a shaving razor cartridge which discharges such remainder to the rear portion r thereof may be ensured.

FIG. 8 illustrates a shaving razor cartridge 60 in which the razor blades as above are mounted.

Referring to FIG. 8, the shaving razor cartridge 60 includes a housing 62, a guard rubber 64, a lubricant band 66, a clip 68, and the razor blades 40.

The housing 62 forms an external appearance of the shaving razor cartridge 60, and provides a structure to install the razor blades 40 therein. The housing 62 accommodates therein the guard rubber 64, the lubricant band 66 and the clip 68. The material of the housing 62 according to the present exemplary embodiment includes plastic, but not limited thereto, and may further include wood, metal or the like.

The guard rubber 64 is formed adjacently to the cutting edge of the razor blades 40, and allows the hair to stand so that the razor blades 40 cut the hair without difficulty.

The lubricant band 66 is installed in an opposite direction of the cutting edge of the razor blades 40 for the purposes of securing moisture of the skin and of smoothing the skin. The lubricant band 66 may include chamomile, olive, or allantoin ingredient so that a user may have a feeling of freshness after shaving.

The clip 68 is used to prevent the razor blades 40 from being separated from the housing 62.

FIG. 9 illustrates a performance test result of the razor blades according to the present invention and the conventional razor blades.

The razor blade according to the present invention is 0.075 mm in thickness (according to a first exemplary embodiment) and 0.1 mm (according to a second exemplary embodiment), and the conventional razor blade was products (product 1 and product 2) manufactured by company G currently sold in the market.

The test devices was Instron 5542 test machine of Instron.

In the graph, an abscissa refers to a degree of pressing the razor blade in the unit of mm and an ordinate refers to the force applied.

Referring to FIG. 9, the strength of the razor blade according to the first and second exemplary embodiments of the present invention is weaker than the product 2, but stronger than the product 1 of the company G. That is, even if the cutting edge and the supporter of the razor blade according to the present invention are combined into a single body unlike the conventional razor blade, the razor blade according to the present invention is stronger than the product 1 and is sufficient to be used as a razor blade.

The razor blade according to the present invention is weaker than the product 2, but is thin and excludes an additional razor blade supporter. In consideration of the foregoing, the razor blade according to the present invention is much stronger than the conventional razor blade. The products 1 and 2 are 0.15 mm or more in thickness.

Table 1 below shows repetitive test data.

TABLE 1

| Item | Product 1 | Product 2 | 1st exemplary embodiment | 2nd exemplary embodiment |
|---|---|---|---|---|
| 1 | 260 | 780 | 210 | 160 |
| 2 | 240 | 650 | 170 | 240 |
| 3 | 240 | 650 | 330 | 300 |
| 4 | 220 | 680 | 330 | 400 |
| 5 | 240 | 680 | 280 | 470 |
| Average | 240 | 688 | 264 | 314 |
| Standard deviation | 14.1 | 53.6 | 72.0 | 123.6 |

As in Table 1 above, the razor blade according to the present invention endures more load than the product 1 from company G and is strong enough to be used as a razor blade.

As described above, a razor blade according to the present invention is formed in a single body to thereby reduce manufacturing processes and realize a strength enough to be used as a razor blade.

The invention claimed is:

1. A razor blade cartridge comprising:

a housing:

a razor blade fixedly mounted in the housing including:

an edge that is elongated in a direction orthogonal to a shaving direction, the edge includes a cutting edge formed in a single arch and opposing rear and front faces wherein the cutting edge extends along a longitudinal direction which is orthogonal to the shaving direction;

a connection portion extending and bent from the edge portion toward a direction orthogonal to the longitudinal direction and orthogonal to the shaving direction, the connection portion having faces continuous with the front and rear faces of the edge portion; and a support portion extending from the connection portion in the direction orthogonal to both the longitudinal direction and the shaving direction, the support portion supporting the edge portion and the connection portion, wherein the edge, the connection portion and the support portion are a single body, and wherein the single body remains fixed in a state where:

a middle portion of the cutting edge is convexly curved toward the shaving direction from a straight line connecting opposite ends of the cutting edge and the cutting edge is convexly curved toward the direction orthogonal to both the longitudinal direction and the shaving direction, at a rest position and wherein the opposing rear and front race, the faces of the connection portion, and the support portion are convexly curved toward the direction of shaving at the rest position.

2. The razor blade cartridge according to claim 1, wherein the cutting edge protrudes in a circular shape and distributes a cutting pressure when hair is cut.

3. The razor blade cartridge according to claim 1, wherein a distance from a central portion of the cutting edge to the straight line connecting opposite ends of the cutting edge ranges between 0.01 mm and 2.0 mm.

4. The razor blade cartridge according to claim 1, wherein a distance from a central portion of the cutting edge to the straight line connecting opposite ends of the cutting edge is 0.2 mm.

5. The razor blade cartridge according to claim 1, wherein the cutting edge protrudes in a circular shape and a radius of the circle ranges between 210 mm and 220 mm.

6. The razor blade cartridge according to claim 1, wherein a thickness of the razor blade ranges between 0.075 mm and 0.2 mm.

7. A shaving razor blade cartridge comprising:

a housing; and a plurality of razor blades wherein each blade comprises an edge that is elongated in a direction orthogonal to a shaving direction and which includes a curved cutting edge formed in a single arch and opposing rear and front faces, wherein the cutting edge extends along a longitudinal direction which is orthogonal to the shaving direction;

a connection portion extending and bent from the edge portion toward a direction orthogonal to a longitudinal direction and orthogonal to the shaving direction, the connection portion having faces continuous with the front and rear faces of the edge portion, and a support portion extending from the connection portion in the direction orthogonal to both the longitudinal direction and the shaving direction wherein the edge, the connection portion and the support portion are a single body, and wherein the single body remains fixed in a state where: the cutting edge extends along the longitudinal direction which is orthogonal to the direction of shaving, a middle portion of the cutting edge is convexly curved toward the shaving direction from a straight line connecting opposite ends of the cutting edge and the cutting edge is convexly curved toward the direction orthogonal to both the longitudinal direction and the shaving direction, at a rest position, and wherein the opposing rear and front face, the faces of the connection portion, and the support portion are convexly curved toward the direction of shaving at the rest position.

8. The shaving razor cartridge according to claim 7, wherein the plurality of razor blades comprises two to ten razor blades.

9. The shaving razor cartridge according to claim 7, wherein a distance from the first razor blade to the last razor blade of the plurality of the razor blades ranges between 1.0 mm and 8.0 mm.

10. The shaving razor cartridge according to claim 7, wherein a distance between the plurality of razor blades ranges between 0.5 mm and 0.9 mm.

11. The shaving razor blade cartridge according to claim 7, wherein the cutting edge protrudes in a circular shape and distributes a cutting pressure when hair is cut.

12. The shaving razor cartridge according to claim 7, wherein a distance from a central portion of the cutting edge to the straight line connecting opposite ends of the cutting edge ranges between 0.1 mm and 2.0 mm.

13. The shaving razor cartridge according to claim 7, wherein a distance from a central portion of the cutting edge to the straight line connecting opposite ends of the cutting edge is 0.2 mm.

14. The shaving razor cartridge according to claim 7, wherein a thickness of the razor blade ranges between 0.075 mm and 0.2 mm.

* * * * *